United States Patent [19]

Ovard

[11] 4,133,851

[45] Jan. 9, 1979

[54] COOLING TOWER SPLASH BAR FILL ASSEMBLY AND METHOD

[75] Inventor: John C. Ovard, Santa Rosa, Calif.

[73] Assignee: Ecodyne Corporation, Santa Rosa, Calif.

[21] Appl. No.: 795,691

[22] Filed: May 11, 1977

[51] Int. Cl.[2] ..... B01F 3/04

[52] U.S. Cl. ..... 261/111; 239/504; 261/113; 261/DIG. 11

[58] Field of Search ..... 261/97, 110–113, 261/DIG. 11, DIG. 72; 210/150, 151; 239/504

[56] References Cited

U.S. PATENT DOCUMENTS

| | | | |
|---|---|---|---|
| 899,665 | 9/1908 | Gould | 261/112 |
| 3,083,148 | 3/1963 | Mojonnier | 261/111 X |
| 3,343,821 | 9/1967 | Winn et al. | 261/112 |
| 3,389,895 | 6/1968 | De Flon | 261/111 |
| 3,468,521 | 9/1969 | Furlong et al. | 261/111 |
| 3,647,191 | 3/1972 | Fordyce | 261/111 |
| 3,791,634 | 2/1974 | Phelps | 261/111 |
| 3,969,447 | 7/1976 | Glitsch et al. | 261/111 |
| 4,020,130 | 4/1977 | Ovard | 261/111 |

FOREIGN PATENT DOCUMENTS

| | | | |
|---|---|---|---|
| 717763 | 1/1932 | France | 261/111 |

*Primary Examiner*—Richard L. Chiesa
*Attorney, Agent, or Firm*—Townsend and Townsend

[57] ABSTRACT

An improved splash bar fill assembly is disclosed comprising a plurality of perforate splash bars, each bar having along its longitudinal axis a horizontally disposed section for intercepting falling liquid and a rib section disposed transverse of said horizontal member for furnishing structural strength. In a preferred embodiment, the rib section, and the horizontal section includes a bevel or a skirt extending from the lateral margins for directing accumulated liquid from the upper surface of the horizontal section to lower, laterally adjacent splash bars.

12 Claims, 9 Drawing Figures

COOLING TOWER SPLASH BAR FILL ASSEMBLY AND METHOD

BACKGROUND OF THE INVENTION

1. Field of the Invention

This invention relates to cooling tower fill assemblies and particularly to an improved splash bar construction for use in crossflow cooling tower installations.

2. Description of Prior Art

Two general orientations for splash bar fill assemblies are known in crossflow cooling tower design. In the more common type, a matrix of horizontally oriented splash bars is disposed with the longitudinal axis of the bars transverse to air flow. When bars are disposed in this orientation, the vertical dimension represents an obstruction to transverse flowing air, which results in high resistance and high induced pressure drop, thereby requiring more energy to induce air flow through the cooling tower and reducing the overall cooling efficiency and economy of operation than might otherwise be obtained. The vertical dimension of said splash bar is usually substantial because of strength and stability requirements of practical and economical fill support and assembly configurations.

Of necessity, splash bars whose longitudinal axis is transverse to air flow must present a relatively low vertical profile, and such shapes compromise strength, which must be compensated for by heavier bars and/or closer spaced support elements. Patents representing this configuration are U.S. Pat. Nos. 3,647,191; 3,468,521; 3,389,895.

A second type of crossflow matrix orientation is known wherein air flow is parallel to the longitudinal axis of the splash bars. Representative configurations include rectangular shaped cross section (U.S. Pat. No. 2,497,389), sinusoidal cross section (U.S. Pat. No. 3,758,088) and the perforated Z, C or I cross sections (U.S. Pat. No. 4,020,130). Each of the splash bar sectional configurations heretofore disclosed wherein the splash bar longitudinal axis is parallel to air flow has particular distinguishing features and characteristics. The differences are subtle, but nevertheless critical. For example, the sinusoidal cross section has a lower cooling efficiency because it does not present a flat surface element to falling liquid which would maximize splash-induced fragmentation of falling liquids, into droplets. It is also subject to a lateral displacement from its normal position. The Z, C or I shape splash bar configurations have the advantages of a flat horizontal splash surface and reasonable structural stability when they are supported on all sides in a grid of suitable strength and rigidity. However, each has minimal or even negative lateral directional control over falling liquid flow, each has a tendency to develop non uniform liquid flow which can reduce cooling efficiency, and each is relatively unstable laterally, which requires that the upper surface element be held in place by an overlying horizontal support element. Much remains to be done to optimize the performance of a splash bar fill assembly, and particularly to develop ultimate functional cooperation between the elements of the structure.

SUMMARY OF THE INVENTION

In order to further advance the art of crossflow cooling tower fill splash bar and assembly design, an improved splash bar fill assembly is provided which is characterized by a matrix of perforate splash bar members, each splash bar member having along its longitudinal axis a horizontally disposed section for intercepting falling liquid and a rib section disposed transverse of the horizontal section for providing structural strength and also providing lateral directional dispersement of falling liquid to both the horizontal element and to laterally disposed lower splash bar members.

In the preferred embodiment the cross section of the splash bar comprises the rib section and the horizontal section with the rib section disposed vertically above the horizontal section. The horizontal section rests on the horizontal elements of vertical grids, each of which is comprised of substantially horizontal and vertical wires or rods, which in turn are supported by the tower structural elements. The vertical wire elements of the grids or rod are disposed adjacent to the lateral extremes of the splash bar horizontal section.

Each horizontal section preferably includes beveled edges or slanting skirts along the edges. The skirt or beveled edge may terminate at or extend beyond adjacent vertical grid elements. The skirts or beveled edges are provided for directing falling liquid that accumulates on the upper surface of the horizontal section in a substantially uniformly distributed manner to the splash bars immediately below and laterally adjacent thereto. The vertical rib section may further include a flow diverting element or deflector, such as a crown or a beveled edge, for laterally deflecting falling liquid impinging upon the rib section onto the horizontal section away from the rib section. The size and the angle of the deflector, the size and pattern of the perforation and the size and angle of the skirts, are chosen to obtain optimal dispersement and uniformity of falling liquid throughout the splash bar elements and the fill assembly area.

A splash bar according to the instant invention has numerous advantages over other known configurations. For example, the rib section and horizontal section improve structural strength and integrity in all directions while acting in cooperation with the other elements to obtain optimal cooling and uniformity of liquid dispersement. This splash bar configuration is self-supporting and maintains its structural integrity and stability without reliance for support from lateral or overlying wire or rod grid elements. Moreover, less material is required to obtain equal or improved cooling performance and structural strength, as compared with known configurations. In addition, a splash bar according to this invention is simple and inexpensive to construct and easy to install in a fill assembly structure.

In the preferred embodiment wherein the splash bar is in the form of an inverted T, the symmetry of the splash bar and its consequently lowered center of gravity also enhances stability, thereby making it less susceptible to displacement by winds or air turbulance. The symmetry also assures uniform stress distribution which minimizes deflection and distortion of the surfaces.

Where the splash bar is suspended with the horizontal section supported by underlying grid elements, the horizontal section experiences tensile forces and is maintained substantially flat and is prevented from warping and sagging which thereby maintains its cooling capability and efficiency.

Still additional advantages are enjoyed by the inventive splash bar configuration. For example, the configuration provides minimal resistance to air flow directed along the longitudinal axis of the splash bar since the end cross section of the splash bar is minimized in the direction of air flow. High heat transfer efficiency is maintained even in the presence of cross winds or turbulence around the cooling tower. The invention also maximizes the amount of surface area of liquid exposed to cooling air by providing efficient liquid dispersion and promoting uniform liquid flow throughout the entire fill assembly area. Further purposes and advantages will be apparent upon reference to the following detailed description of preferred embodiments.

BRIEF DESCRIPTION OF THE DRAWINGS

The invention may be better understood by reference to the following detailed description, taken in conjunction with the accompanying drawings, in which.

DETAILED DESCRIPTION OF THE PREFERRED EMBODIMENTS

Figure 1:
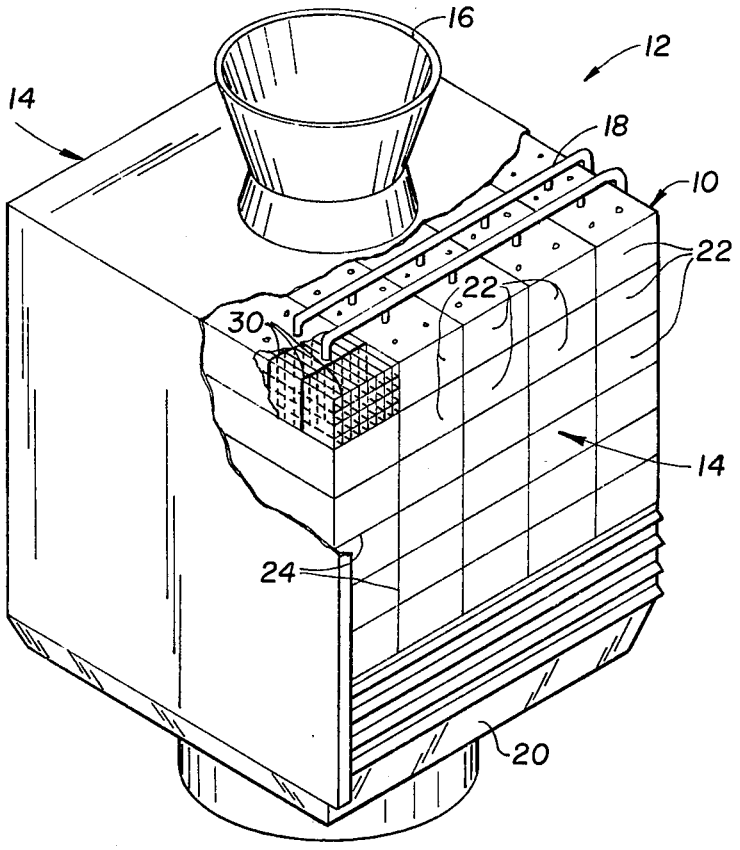
FIG. 1 is an isometric view of an elementary cross-flow cooling tower.

FIG. 1 illustrates an elementary fill assembly area 10 for a cross-flow type cooling tower, 12 adapted for parallel air flow operation. The tower 12 may be either mechanical draft or natural draft type. The mechanical draft tower 12, of FIG. 1, includes side openings defining an air intake area 14 and an air exhaust 16 through a central stack in which is normally mounted an induced draft fan. The tower 12 will have the usual hot water inlet 18 and cool water recovery basin 20, respectively, above and below the fill assembly area 10. The fill assembly area 10 may be divided into longitudinal compartments 22 in alignment between the air intake 14 and exhaust plenum area directly below exhaust stack 16. Each compartment 22 is bound by a structural framework 24 in the fill assembly area 10 which supports the fill members.

Figure 3:
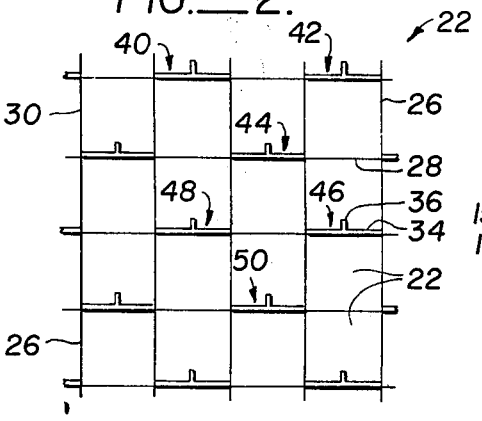
FIG. 3 is an end view of a portion of a fill assembly area and fill hanger grid corresponding to FIG. 2.

Referring to FIG. 3 in conjunction with FIG. 1, each compartment 22 is strung with vertical hanging grids consisting of a plurality of vertical and horizontal wires or rods 26 and 28, respectively, spaced at intervals along the length of each compartment 22.

Figure 2:
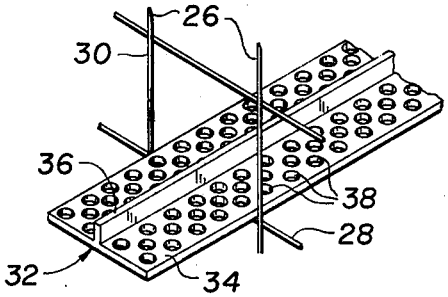
FIG. 2 is a perspective view of one embodiment of a fill element and hanger grid.

Various embodiments of a splash bar 32 according to the invention are illustrated by FIGS. 2–9. Referring particularly to FIGS. 2 and 3, a particular embodiment is illustrated. The splash bar 32 includes a horizontal section 34 and a rib section 36 along the face of the horizontal section 34. The horizontal section 34 may be a plate or sheet of metal, plastic or other material and is provided with perforations 38 of preselected size. Each perforation 38 has a diameter between about one-fourth and one-half inch and is preferably spaced between about one-sixteenth and one-fourth inch from the edge of adjacent perforations 38. In the preferred embodiment, three-eighths inch perforations 38 are provided at the vertices of equilateral triangle, this configuration being found to provide a preferred balance between splash cooling surface area and aperture area for fragmenting water globules, as well as for preventing the formation of a water film over the surface of the perforations 18.

The rib section 36 may be a plate or a sheet of metal or plastic or other material which is integrally formed or bonded transversely to the face of the horizontal section 34. The rib section 36 provides vertical support along the length of the relatively thin horizontal section 34, the height and rigidity of the rib section 36 being selected to carry the longitudinally distributed load of the horizontal section 34. The rib section 36 may be of a relatively low profile to the horizontal section. For example, the height of the rib section 36 may be about three-sixteenths the lateral breadth of the horizontal section 34. Where the rib section 36 is a 3/64 inch plate, its height may be about ¾ inch.

The splash bars are supported under the horizontal section by wire 28 so that the splash bars appear as an inverted "T" in cross section. The bars are arranged in a grid pattern as viewed in cross section. FIG. 3 illustrates one such grid pattern. The grid pattern is adapted to promote cross dispersion of a portion of each amount of liquid falling upon a splash bar. For example, splash bars 40, 42, 44, 46, 48, and 50 are spaced in a regular vertically and horizontally alternating grid pattern. Splash bar 44 is spaced lower and laterally adjacent splash bar 44 in a repetitive pattern. Splash bars 40 and 42 are horizontally aligned along a common horizontal support wire 28, while splash bars 40 and 46, splash bars 44 and 50, and splash bars 42 and 48 are each aligned vertically between two vertical support wires 26, respectively. The edges of the horizontal section 34 abuts the two vertical wires 26, thereby separating vertical columns of splash bars.

Referring to FIGS. 2 and 3, a typical fill assembly compartment 22 functions as follows. Liquid falling under gravity from overlying compartments 22 directly or indirectly from the water distribution system 18 encounters the upper horizontal level of splash bars, e.g., splash bars 40 and 42 and splash bar 44. Liquid strikes the upwardly disposed side of horizontal section 34 of the splash bars. An amount falls directly through perforations 38 (FIG. 2) to the next lower level of splash bar, the liquid being fragmented by the sized perforations 38. The falling liquid droplets are cooled through evaporation and convection by air moving generally parallel to the longitudinal axis of the splash bars. Other amounts of liquid encountering horizontal section 34 splash on the horizontal surfaces and are dispersed and deflected laterally as they continue to fall. Some of the deflected amount is redirected by the top of the vertical rib section 36. Still other portions of the liquid are dispersed longitudinally along the bar or fall laterally to the next adjacent and lower splash bar, also being cooled by air. The remainder of the liquid temporarily coats the splash bar in a thin film which also cools the liquid. Thereafter the liquid falls to the next lower bars and the process is repeated. Cooled liquid ultimately collects in water recovery area 20 (FIG. 1) for subsequent reuse or disposal.

Figure 4:
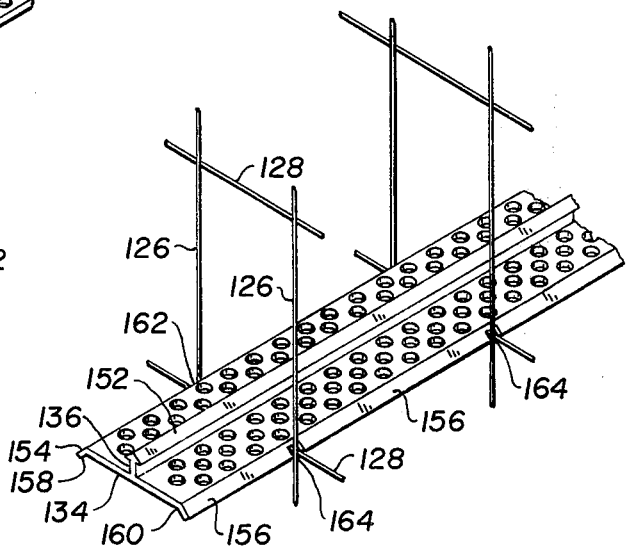
FIG. 4 is a perspective view of a second embodiment of a fill element and hanger grid.
Figure 5:
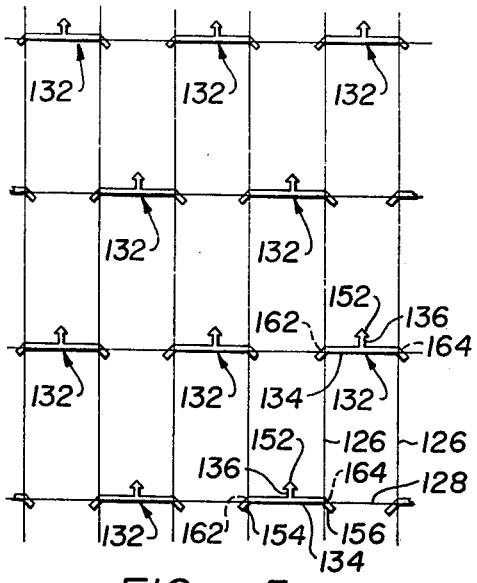
FIG. 5 is an end view of a fill assembly area and fill hanger grid corresponding to FIG. 4.

FIGS. 4 and 5 illustrate a further embodiment of the invention. A splash bar 132 includes a horizontal section 134, a rib section 136, a diverter 152 along with top of rib section 136 and skirts 154 and 156 extending outwardly and downwardly from the lateral ends 158, 169, of horizontal section 134.

The diverter 152 may be an oblique surface sheet or bead. The diverter may be either asymmetric or symmetric relative to the rib section 136. The diverter 152 provides two functions which enhance the operation of the invention as described in conjunction with FIG. 3. First, diverter 152 serves to laterally divert falling liquid to minimize accumulation of liquid adjacent to and on rib section 136. Second, diverter 152 serves to strengthen rib section 136 against lateral flexure. Rib section 136 is generally under compression, so a tendency to buckle may be encountered under some loading conditions. Horizontal section 134 is maintained under tension between grid supports so the horizontal section is stretched to a flat smooth surface.

The skirts 154 and 156 may be extensions of horizontal section 134. Each skirt preferably is imperforate and includes notches 162, 164 abutting the ends 158, 160. Notches 162, 164 are spaced to mate with the grid wires 126, 128 at their intersections. The skirts and notches serve two purposes. First, the skirts which extend outwardly of the vertical wires 126, vertically overlap lower, laterally adjacent splach bars and divert accumulated liquid more centrally onto horizontal sections 134 of the such lower splash bars. Second, the notches 162, 164, in the skirts 154, 156 interlock with the wire grid to hold the grid in place and to prevent displacement of the splash bars.

Referring particularly to FIG. 5, it is to be noted that the vertical and horizontal spacings between the splash bars 132 differ. In particular, the wire grids define vertically elongated rectangular air passages with splash bars 132 across the bottom of every other air passage. Furthermore, the rib section 136 of each splash bar 132 is relatively short vertically so the center of gravity is relatively low. Splash bars 132 are thus relatively stable and require no overhead support. Further, the splash surface vertical spacing can be selected within a substantial range.

Figure 6:
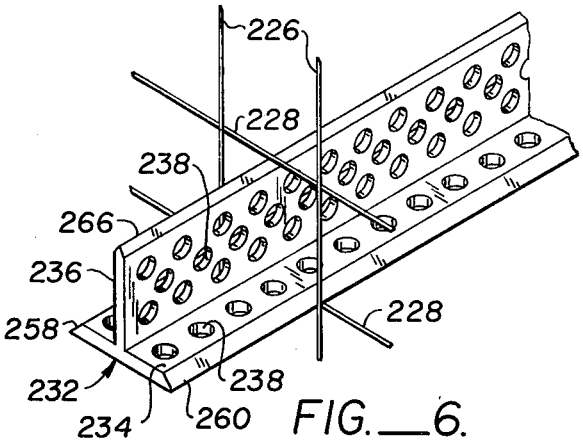
FIG. 6 is the perspective view of a further embodiment of a fill element and hanger grid.
Figure 7:
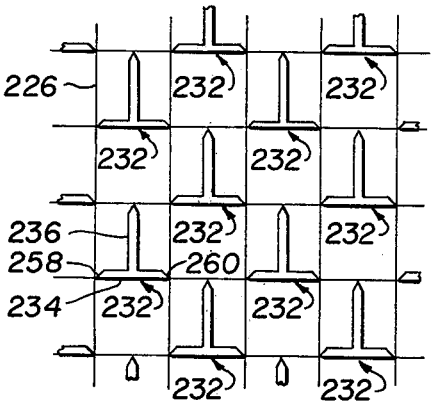
FIG. 7 is an end view of a portion of a fill assembly area and hanger grid corresponding to FIG. 6.

FIGS. 6 and 7 show a further embodiment of the invention. Splash bars 232 comprise a first horizontally disposed plate 234 and a second vertically disposed plate 236 which is attached symmetrically to the longitudinal axis of horizontal plate 236. Both horizontal and vertical plates 234 and 236 may be relatively thick as compared to their breadth.

Horizontal plate 234 and vertical plates 236 may be approximately equal surface area and may include perforations 238 between opposing surfaces to permit the passage of air and liquid. Each splash bar 232 is mounted in an enclosing grid of vertical and horizontal wires 226 and 228. The splash bars 232 are arranged in a vertically and horizontally alternating pattern. The upwardly disposed face plates 234 are beveled at edges 258, 260 for diverting falling liquid to lower, laterally disposed splash bars 232. Further, top 266 of vertical plate 236 is beveled to a point along its length. Beveled top 266 serves to laterally divert liquid falling thereon.

Figure 8:
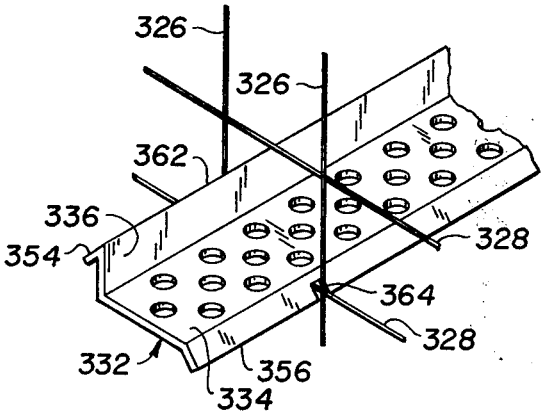
FIG. 8 is a perspective view of a still further embodiment of a fill element and hanger grid.
Figure 9:
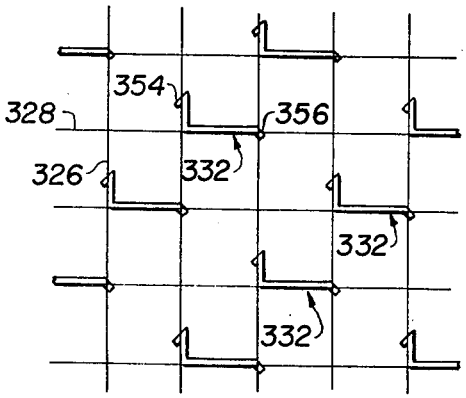
FIG. 9 is an end view of a portion of a fill assembly area and fill hanger grid corresponding to FIG. 8.

FIGS. 8 and 9 show a still further embodiment. Splash bars 332 comprise a perforate horizontal plate 334 and a vertical plate 336. Vertical plate 336 is attached along one edge of horizontal plate 334 to define an "L" in cross section. Extending laterally downwardly from the lateral extremities of both vertical plate 336 and horizontal plate 334 are skirts 354 and 356 for diverting falling liquid to lower, laterally adjacent splash bars 332. Each of the skirts 354, 356 includes notches 362, 364 for engaging vertical and horizontal support wires 326 and 328. The skirts 354 and 356 overhand adjacent splash bars for increasing lateral distribution of falling liquid. Any variety of grid patterns may be employed, the asymmetric pattern of FIG. 9 being only one example. As another example, the "L" cross section may be alternated vertically and horizontally and the splash bars 332 may be spaced in a vertically symmetric and horizontally assymmetric pattern, as viewed in cross section.

The invention has been described with reference to specific embodiments. Other embodiments may be suggested to those of ordinary skill in the art, in light of the various examples disclosed herein. It is therefore not intended that the invention be limited except as indicated by the appended claims.

I claim:

1. A splash bar fill assembly for a crossflow cooling tower comprising:

a plurality of splash bars, each splash bar comprising a longitudinally extending relatively thin substantially planar perforate horizontal section, a relatively thin vertically disposed rib section connected longitudinally to said horizontal section along an upper longitudinal face thereof, the height of said rib section being greater than the thickness of said horizontal section, means along the top of said rib section for laterally diverting falling liquid impinging upon said rib section onto said horizontal section, means appended to the upper face of said splash bar for guiding liquid laterally of said horizontal section to inhibit liquid accumulation upon said upper face, said horizontal section being adapted to intercept and fragment falling liquids; and means for supporting said splash bars in horizontal alignment and axially parallel to normal air flow, said splash bars being disposed in a vertically and laterally alternating rib pattern for fragmenting and cooling falling liquid and for dispersing falling liquid laterally of said air flow.

2. A splash bar fill assembly according to claim 1 wherein said liquid guiding means comprises at least one downwardly and laterally extending skirt along a lateral margin of said splash bar.

3. A splash bar fill assembly according to claim 1 wherein said rib section is a relatively rigid sheet and wherein said diverting means comprises a crowned rigid skirt for bracing said rib section against lateral flexure and for diverting said rib section impinging liquid a laterally spaced distance from said rib section.

4. A splash bar fill assembly according to claim 3 wherein said rib section is disposed substantially along the center of the upper longitudinal face of said horizontal section.

5. A spash bar fill assembly according to claim 1 wherein said supporting means comprises at least one grid transverse of said splash bars comprising vertical wires for laterally spacing said splash bars and for supporting a tension load and horizontal wires for supporting at least one splash bar, each said vertical and horizontal wire being linked to define a joint adjacent a lateral margin of said horizontal section, and wherein said splash bar further comprises at least two skirts longitudinally spaced along said margin, said two skirts defining a notch to interlock said wire joint to said splash bar for containing said splash bar in said grid, said skirts extending laterally and downwardly from said margin beyond said joint for directing falling liquid onto lower, laterally adjacent splash bars.

6. A splash bar fill assembly according to claim 5 wherein said rib section further comprises a bottom margin and a top margin, said bottom margin adjoining an upwardly disposed face of said horizontal section and said top margin defining a diverting means for laterally diverting liquid which falls onto said rib section to said horizontal section.

7. For a splash bar fill assembly of a parallel air flow-type crossflow cooling tower, a splash bar for mounting in substantially horizontal orientation in said fill assembly, said splash bar comprising:

a longitudinally extended relatively thin horizontal section having an obverse face, a reverse face and first and second lateral margins, and including perforations between said obverse face and said reverse face;

a longitudinally extended relatively thin rib section of rectangular cross-section, said rib section having first and second opposing faces and third and fourth lateral margins said third margin longitudinally adjoining said obverse face between said first and second margins, said rib section being disposed upwardly transverse of said horizontal section for adding vertical structural rigidity to said horizontal section, the height of said rib section being greater than the thickness of said horizontal section;

a longitudinally extended diverting means having an upper surface and a generally opposing lower surface, and fifth and sixth lateral margins, said lower surface longitudinally adjoining said fourth margin, wherein said upper surface is disposed laterally obliquely of said horizontal section, said first and second margins are extended laterally of said fifth and sixth margins, and said fifth and sixth margins are extended transverse of said rib section for directing liquid which falls onto said diverter means laterally onto said obverse face.

8. An apparatus according to claim 7 wherein said horizontal section includes first and second longitudinal bevels along said first and second margins for directing liquid which falls onto said horizontal section onto lower, laterally adjacent splash bars.

9. An apparatus according to claim 7 wherein said horizontal section includes longitudinal skirts extending laterally and downwardly of said first and second margins for directing liquid which falls onto said horizontal section to selected locations of lower, laterally adjacent splash bars.

10. An apparatus according to claim 9 wherein said skirts include a notch for interlocking with means for supporting said splash bar.

11. An apparatus according to claim 7 wherein said horizontal section is adapted to be longitudinally suspended such that said rib section is maintained under compression and said horizontal section is maintained under tension between means for supporting said splash bar thereby to hold said horizontal section as a substantially flat, smooth surface for promoting efficient cooling.

12. A method of cooling a liquid in a crossflow cooling tower wherein said cooling tower includes a fill assembly with a plurality of longitudinally extended splash bars having a horizontal section with perforations and a rib section adjoining the upper face of said horizontal section, the height of said rib section being greater than the thickness of said horizontal section, said splash bars being disposed in cross section in a horizontal and vertical grid pattern, said method comprising the steps of:

flowing air through said fill assembly longitudinally parallel to said splash bars;

splashing warm liquid through said fill assembly transverse of said air flow;

directing a first portion of said liquid downwardly to impinge upon said rib section of said splash bars to fragment and to laterally disperse said first portion onto said horizontal section of said splash bars;

directing a second portion of said liquid downwardly to impinge upon said horizontal section;

directing a third portion of said liquid downwardly to pass through said perforations and to impinge upon a lower splash bar for fragmenting said third portion;

deflecting said first, second and third portions laterally of said splash bars for dispersing said liquid laterally of air flow through said fill assembly; and repeating said flowing, splashing, directing, and deflecting steps through said fill assembly to fragment said liquid into uniformly dispersed droplets for creating maximum heat exchange surface between said liquid and air.

* * * * *